United States Patent [19]

Tippmer

[11] 4,045,970

[45] Sept. 6, 1977

[54] METHOD AND APPARATUS FOR THE INDIRECT COOLING OF HOT GASES, PARTICULARLY, COKE OVEN GASES

[75] Inventor: Kurt Tippmer, Recklinghausen, Germany

[73] Assignee: Firma Carl Still Recklinghausen, Germany

[21] Appl. No.: 732,958

[22] Filed: Oct. 15, 1976

[30] Foreign Application Priority Data

Oct. 21, 1975 Germany ..... 2547034

[51] Int. Cl.[2] ..... F25D 17/06; F25D 17/02; F25B 7/00

[52] U.S. Cl. ..... 62/95; 62/99; 62/335

[58] Field of Search ..... 62/95, 96, 98, 99, 415, 62/335

[56] References Cited

U.S. PATENT DOCUMENTS

| | | | |
|---|---|---|---|
| 2,495,625 | 1/1950 | Bodinus | 62/99 |
| 2,903,861 | 9/1959 | Alcus | 62/96 |
| 3,300,991 | 1/1967 | Carney | 62/335 |

*Primary Examiner*—Lloyd L. King
*Attorney, Agent, or Firm*—McGlew and Tuttle

[57] ABSTRACT

A method for the indirect cooling of hot gases, particularly, coke oven gases using a gas cooler having a cooling chamber with three different heat exchangers arranged therein, comprises directing the gases to be cooled through first one of the heat exchangers while circulating a coolant through the first heat exchanger which comprises a heater agent taken from the desorber stage of an absorber-desorber-type refrigerating machine. The gases are then directed through the second heat exchanger while circulating ordinary cooling water therethrough and, thereafter, the gases are directed through a third heat exchanger while the heating agent from an evaporator stage of the refrigerating machine is circulated through the third heat exchanger. The apparatus includes a gas cooler housing having the various first, second and third heat exchangers therein, and with a refrigerating machine connected in a circuit for supplying a higher temperature transfer medium to the first heat exchanger and a coolant medium below the temperature of the cooling water to the third heat exchanger.

6 Claims, 1 Drawing Figure

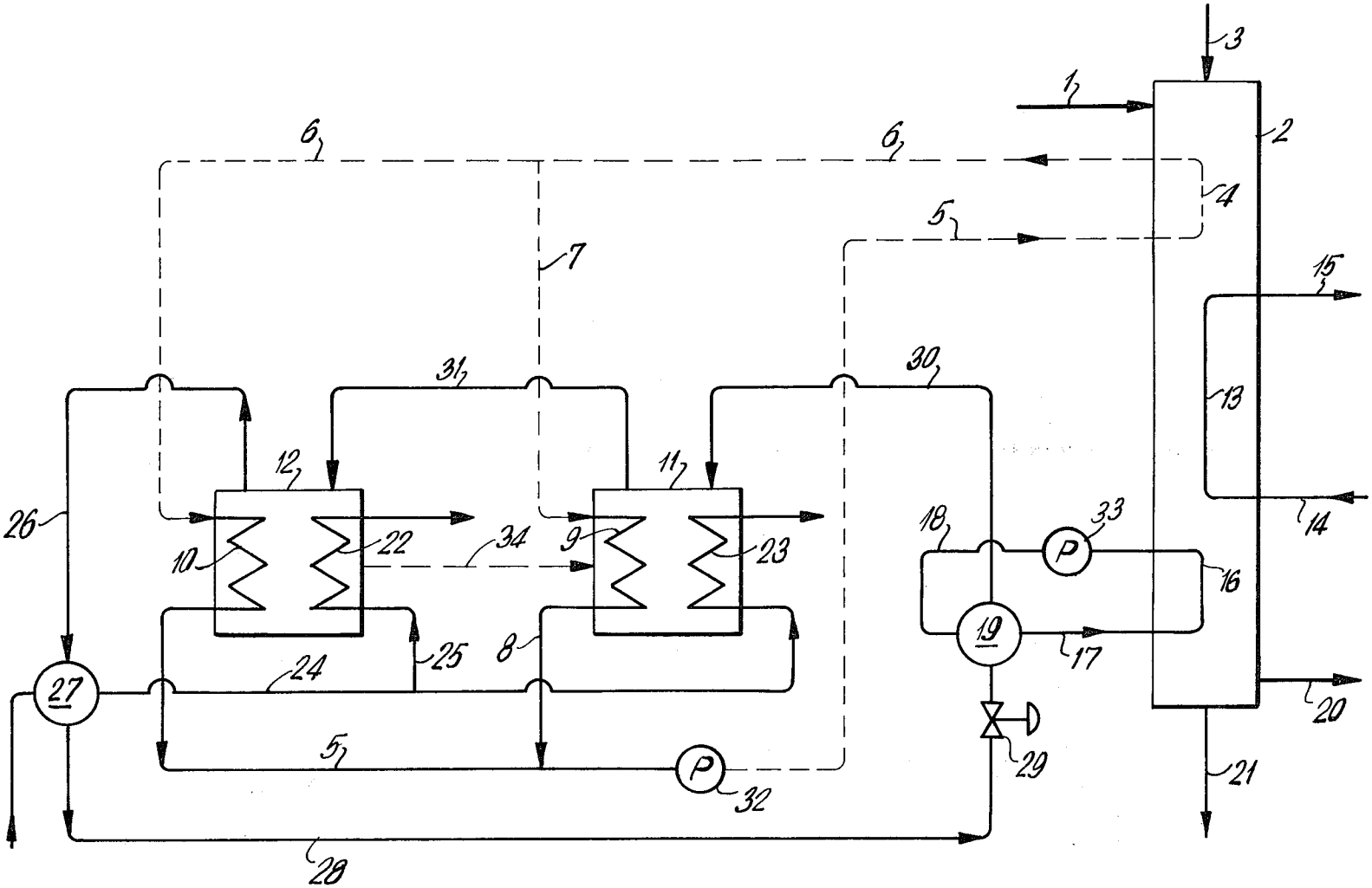
1
2
3
4
5
6
7
8
9
10
11
12
13
14
15
16
17
18
19
20
21
22
23
24
25
26
27
28
29
30
31
32
33
34
P
P

METHOD AND APPARATUS FOR THE INDIRECT COOLING OF HOT GASES, PARTICULARLY, COKE OVEN GASES

FIELD AND BACKGROUND OF THE INVENTION

This invention relates in general to a method and apparatus for treating coke oven gases and, in particular, to a new and useful method and apparatus for the indirect cooling of such coke oven gases.

DESCRIPTION OF THE PRIOR ART

In many industrial countries, the climate is such that there is a relatively high average annular temperature so that available cooling water comes from rivers and lakes in which the temperatures are from 20° and 30° C and even higher. In such countries, hot gases, including coke oven gases are cooled in circuits which employ refrigerating machines in order to cool the gases to an end temperature below or at least at the cooling water temperature. The known methods are relatively costly because much energy in the form of electric current or steam must be expended for the operation of the compressors of a compressor-type refrigerating machine or for operating the evaporation stage of an absorber-desorber type refrigerating machine. The high costs for cooling enter into the costs of the total method and have an adverse effect on its economy.

SUMMARY OF THE INVENTION

In accordance with the present invention, a method has been found for cooling hot gases which is especially applicable for countries having high average annular temperatures in a system wherein at least part of the energy which had to be expended in the known methods can be saved. In accordance with the invention, the hot gases are cooled in three stages, including a first stage with a coolant that serves as a heating agent in an absorber-desorber-type refrigerating machine, a second stage in which relatively hot cooling water is employed, and a third stage using a coolant that serves as a heating agent in the evaporator stage of an absorber-desorber-type refrigerating machine.

In some instances, the second stage is divided into several stages, for example, such as two stages. As a coolant in the first and third stages, the cooling stages conducted over the refrigerating machine can circulate solutions which contain salts, for example, calciumchloride, or compounds such as polyvalent alcohols, e.g., glycols, between the heat exchangers and the refrigerating machine. The refrigerating machine is preferably operated with aqueous ammonia as a coolant. For cooling water temperatures between 20° and 30° C, aqueous ammonia with a content of 60% to 70% $NH^3$ has proven particularly favorable. The energy needed in the method of the invention is only that required for driving circulation pumps and for no other purpose. No energy is used at other points of the cooling system. This amount of energy is relatively small. It is, for example, 60 to 70kW, while 160 to 170kW must be expended for the same cooling effect in other methods.

Accordingly, it is an object of the invention to provide a method of cooling hot gases, particularly, coke oven gases indirectly, using a gas cooler which has a cooling chamber with three different heat exchangers arranged therein and which comprises, directing gases to be cooled through the first heat exchanger, while circulating a coolant through the first heat exchanger which comprises a heating agent taken from the desorber stage of an absorber-desorber-type refrigerating machine, directing the gases to be cooled through a second heat exchanger while circulating cooling water therethrough and, finally, directing the gases through a third heat exchanger while circulating a heating agent taken from the evaporator stage of the absorber-desorber-type refrigerating machine to reduce the gas to a temperature below the circulating water.

A further object of the invention is to provide an apparatus for cooling gases, which comprises three separate heat exchangers arranged in order in the gas-cooling chamber, with an intermediate stage having cooling water circulating therethrough, and with a first stage having an absorber-desorber-type refrigerating machine with a desorber stage connected to the heat exchanger to permit the heating agent for this stage to be circulated therethrough, and with a third stage heat exchanger connected to the evaporator stage of the refrigerating machine.

A further object of the invention is to provide an apparatus for the indirect cooling of hot gases, particularly, coke oven gases, which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there is illustrated a preferred embodiment of the invention.

BRIEF DESCRIPTION OF THE DRAWING

In the Drawing:

The only FIGURE of the drawing is a schematic representation of an apparatus for cooling hot gases constructed in accordance with the invention.

DESCRIPTION OF THE PREFERRED EMBODIMENT

Referring to the drawing in particular, the invention embodied therein, comprises an apparatus for cooling hot gases, particularly, coke oven gases in a system in which 16,250 $Nm^3$ water-saturated coke oven gas is cooled per hour from 81° C to 20° C, using cooling water which is of a temperature of 28° C. With such cooling water alone, it is not possible to cool the gas below 30° C.

In accordance with the invention, the gas enters a gas precooler 2 through a line 1. Wash water of 80° C, (so-called $NH^3$-water, carbon water) in a quantity of 20 $m^3$ enters through the line 3, so that the entire gas stream is sprayed across the cross-section of the precooler 2. Preferably, a tarry ammonia water is used, because it prevents the formation of naphthalene deposits in the gas precooler and on the fittings thereof.

In accordance with a feature of the invention, the gases to be cooled pass a plurality of heat exchangers, including a first heat exchanger 4 in a first cooling stage, which comprises a hot water stage. Heat exchanger 4 is supplied with a heat transfer medium from a refrigerating machine which is charged with 34 0 $m^3$ of soft water, and which includes the cooling units 4 as well as of the feed and discharge pipes 5, 6, 7 and 8, with a circulating pump 32 for circulating the medium through a heat exchanger 9 in a low pressure absorbing system 11 and a heat exchanger 10 in a high pressure absorbing system 12 of the refrigerating machine. The soft water flows to the cooling units 4 at a temperature of 70° C and issues back through the return line 6 at a temperature of 75° c.

The gases then pass through a second cooling stage past a heat exchanger 13 through which cooling water is circulated through an inlet 14 and an outlet 15. The inlet water is at a temperature in the range of from 28° to 35° C, and it is heated up to about 40° C. The gases then pass through a third heat exchanger 16, which comprises a cold water stage of the refrigerating machine and the gases in passing are cooled to 20° C by the cooler heat exchanger 16. Heat exchanger 16 includes feed and discharge pipes 17 and 18, with a circulating pump 33 for circulating the medium through an evaporator 19.

Cooled gases are removed through a discharge 20 at the lower end of the precooler 2, and 12.1 $m^3$ of gas condensate are withdrawn through line 21 with 20 $m^3$ of wash water or a total of 31.1 $m^3$ of water.

The refrigerating plant also includes cooling units 22 and 23 in the high pressure and low pressure systems 12 and 11, respectively, which are connected through feed pipes 24 and 25 and discharge out through discharge pipes, not shown. The cooling water used for this purpose has first passed through the ammonia condenser 27, which is connected by lines 26 and 28 through a valve 29 with the evaporator 19 and this supplies evaporated ammonia through line 30 to the low pressure absorber system 11. The desorber unit 9 of the low pressure absorber system 11 is connected through line 31 with the high pressure absorber system 12. A return pipe 34 is provided between the low pressure system 11 and the high pressure absorber system 12.

An advantage of the system is that the only energy required for the operation of the device is spent for operating the circulating pumps 32 and 33.

| Balance | |
|---|---|
| Input heat of gas | 8,4000,000 kcal |
| Input heat of wash water | 1,6000,000 kcal |
| Total heat | 10,000,000 kcal |

The heat is eliminated in a three-stage system consisting of a hot water, a cooling water, and cold water stage, of which the first and third stages are part of a circuit of a refrigerating machine.

The cooling of the gases with the cooling water at 28° C is effected down to 35° C with the residual heat in the gas and water being still 1,780,000 kcal/h. The further cooling of the gas to 25° C is effected by means of cold water of 18° C from the absorber-type refrigerating machine. The residual heat in the gas and water at 25° C is 1,090,000 kcal/h, that is, 690,000 kcal/h must be eliminated with the cold water. The amount of cold water is 90 t/h with heating of 7° C. The cold water is produced in the $NH^3$ evaporator 16. The liquid $NH^3$ evaporates at +10° C and 6.2 bars. The amount of $NH^3$ is 2660 kg/h.

The production of 690,000 kcal/h cold of 30 10° C requires about 1,7000,000 kcal/h heat, which is obtained in the form of hot water of 75° C in the upper part of the gas precooler 2; the gas being cooled to 77.5° C. The amount of heat for the cooling water stage 9 or precooler 2 is thus reduced from 8,220,000 kcal/h to 6,522,000 kcal/h. This amount of cooling water is thus 543 $m^3h$ with a heating of 12° C.

The evaporated $NH^3$ of evaporator 19 of the cold water stage is absorbed in the low pressure absorber 11 at 6.2 bars and 35°/45° C. The concentration gradient in the absorber is at 50 to 57% by weight. In the desorder, the solution is regenerated at 10 bar, and the $NH^3$–$H_2O$ mixture is absorbed by the high pressure absorber. The boiling temperature in the low pressure absorber is 62° C at 10 bar.

In the high pressure absorber 12, the concentration gradient 63 is at 80% by weight. In the high pressure desorber, the solution is regenerated at 16 bar with the reverse gradient. The boiling temperature is at 16 bar, likewise at 62° C. $NH^3$ is condensed at 16 and delivered with 40° C to evaporator 19. If necessary, the liquid $NH^3$ (70° C) can be supercooled in counterflow with the vaporous $NH^3$ (10° C). The heating of the two absorber systems 11 and 12 is effected with hot water of 75° C, which is cooled to 70° C.

The cooling water of 28° C is first conducted through condenser 26 and subsequently through the two absorbers 12 and 11, which work at an absorption temperature of 35° to 45° C.

The absorber-type refrigerating plant of principally known design can be easily operated at a cooling water temperature of 30° C.

While a specific embodiment of the invention has been shown and described in detail to illustrate the application of the principles of the invention, it will be understood that the invention may be embodied otherwise, without departing from such principles.

What is claimed is:

1. A method for the indirect cooling of hot gases, particularly, coke oven gases, using a gas cooler having a cooling chamber with three different heat exchangers arranged therein, comprising directing the gases to be cooled through a first heat exchanger in the gas cooler while circulating a coolant through the first heat exchanger which comprises a cooling medium taken from the desorber stage of an absorber-desorber-type refrigerating machine, thereafter directing the gases through a second heat exchanger while cooling water is circulated through the heat exchanger and finally directing the gases through a third heat exchanger while circulating a cooling agent taken from the evaporator stage of the refrigerating machine.

2. A method for the indirect cooling of hot gases, according to claim 1, wherein the second stage in which cooling water is circulated is divided into two partial cooling water stages in which cooling water is circulated in heat exchange relationship with the gases.

3. A method for the indirect cooling of hot gases, according to claim 1, in which a water of aqueous solution which contains salt, such as calcium chloride, or compounds such as a polyvalent alcohol or glycol are circulated through the first and third stage heat exchangers.

4. A method for the indirect cooling of hot gases, according to claim 1, wherein the refrigerating machine is operated with an aqueous ammonia or a lithium-bromide solution as a coolant.

5. A method for the indirect cooling of hot gases, according to claim 1, in which a cooling water of 20° C to 30° C is circulated in the second stage heat exchanger and aqueous ammonia with 60% to 70% ammonia is used in the third heat exchanger.

6. An apparatus for the indirect cooling of hot gases, particularly, coke oven gases, comprising a gas cooler housing having an interior gas cooling chamber, a gas inlet for the gases to be cooled connected into said gas cooling chamber, a gas outlet extending out of said cooling chamber at a spaced location from said gas inlet, a first relatively highest temperature cooler, a second relatively intermediate temperature cooler and a third relatively lowest temperature cooler arranged in order in said gas cooling chamber between said inlet and said outlet, said first cooler comprising an absorber-desorber-type refrigerating machine having a desorber stage with a heating agent, and means for circulating said heating agent as a coolant into said first cooler in said gas cooling chamber, said second cooler comprising means for circulating water into said gas cooling chamber for heat exchange with said high temperature gases, and said third cooler comprising an evaporator stage of said refrigerator machine, and means for circulating the heating agent of said evaporator stage into said gas cooling chamber.

* * * * *